US010600553B2

(12) United States Patent
Yoon et al.

(10) Patent No.: US 10,600,553 B2
(45) Date of Patent: Mar. 24, 2020

(54) INDUCTOR HAVING VIA CONNECTION LAYER

(71) Applicant: SAMSUNG ELECTRO-MECHANICS CO., LTD., Suwon-si, Gyeonggi-do (KR)

(72) Inventors: Chan Yoon, Suwon-si (KR); Dong Hwan Lee, Suwon-si (KR); Young Ghyu Ahn, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 144 days.

(21) Appl. No.: 15/457,475

(22) Filed: Mar. 13, 2017

(65) Prior Publication Data

US 2018/0033539 A1 Feb. 1, 2018

(30) Foreign Application Priority Data

Jul. 27, 2016 (KR) ..... 10-2016-0095686

(51) Int. Cl.

| | |
|---|---|
| ***H01F 27/28*** | (2006.01) |
| ***H01F 17/00*** | (2006.01) |
| ***H01F 27/29*** | (2006.01) |
| ***H01F 27/24*** | (2006.01) |
| *H01F 17/04* | (2006.01) |

(52) U.S. Cl.

CPC ..... *H01F 27/2804* (2013.01); *H01F 17/0013* (2013.01); *H01F 27/24* (2013.01); *H01F 27/292* (2013.01); *H01F 2017/048* (2013.01); *H01F 2027/2809* (2013.01)

(58) Field of Classification Search

CPC ..... H01F 27/2804; H01F 27/24; H01F 2027/2809

USPC ..... 336/200, 232

See application file for complete search history.

(56) References Cited

U.S. PATENT DOCUMENTS

| | | | | |
|---|---|---|---|---|
| 6,362,716 | B1 * | 3/2002 | Anbo | H01F 17/0013 336/200 |
| 6,498,555 | B1 | 12/2002 | Sakata | |
| 7,046,114 | B2 * | 5/2006 | Sakata | H01F 17/0013 336/200 |
| 2010/0308949 | A1 | 12/2010 | Lim et al. | |
| 2013/0214889 | A1 | 8/2013 | Kim et al. | |
| 2013/0314193 | A1 * | 11/2013 | Lee | H01F 17/0013 336/200 |
| 2015/0028988 | A1 * | 1/2015 | Yamauchi | H01F 27/2804 336/200 |

(Continued)

FOREIGN PATENT DOCUMENTS

| | | | | |
|---|---|---|---|---|
| JP | 2001-044035 A | | 2/2001 | |
| JP | 2015076597 A | * | 4/2015 | H01F 27/2804 |

(Continued)

*Primary Examiner* — Tszfung J Chan

(74) *Attorney, Agent, or Firm* — Morgan, Lewis & Bockius LLP

(57) ABSTRACT

An inductor includes a body including a coil part therein. The coil part includes a first coil layer electrically connected to a first via; a second coil layer disposed below the first coil layer and electrically connected to a second via displaced laterally from that of the first via; and a via connection layer disposed between the first coil layer and the second coil layer and electrically connected to the first and second vias.

18 Claims, 5 Drawing Sheets

(56) References Cited

U.S. PATENT DOCUMENTS

| | | | | |
|---|---|---|---|---|
| 2015/0102890 | A1* | 4/2015 | Nakamura | H01F 27/2804<br>336/200 |
| 2017/0103845 | A1* | 4/2017 | Nagai | H01F 27/2804 |
| 2018/0286563 | A1* | 10/2018 | Shinkai | H01F 27/2804 |

FOREIGN PATENT DOCUMENTS

| | | | | |
|---|---|---|---|---|
| KR | 10-2009-0097303 | A | | 9/2009 |
| KR | 10-2015-0042169 | A | | 4/2015 |
| KR | 20170097865 | A | * | 8/2017 |

* cited by examiner

INDUCTOR HAVING VIA CONNECTION LAYER

CROSS-REFERENCE TO RELATED APPLICATION(S)

This application claims the benefit of priority to Korean Patent Application No. 10-2016-0095686, filed on Jul. 27, 2016 in the Korean Intellectual Property Office, the entire disclosure of which is incorporated herein by reference.

BACKGROUND

1. Technical Field

The present disclosure relates to an inductor.

2. Description of Related Art

As electronic products are increasingly reduced in size and thickness and become more multi-functional, the demand for small, thin inductors is growing. A chip-type inductor is largely used in a power circuit such as a DC/DC converter of a portable device, and, through miniaturization, has been provided with high current and low DC resistance.

In an inductor, a via may be used to connect coil layers positioned on upper and lower sides of the inductor. In a portion where the via is positioned, a via pad larger than the via may be applied to a coil part, in consideration of alignment, in the formation of the via. Here, due to an area of the via pad, a core may not be uniformly filled with a magnetic material and magnetic flux may concentrate in a region, to degrade properties of the inductor.

Thus, a method for preventing concentration of a magnetic flux density that occurs within the core is required.

SUMMARY

An aspect of the present disclosure may provide an inductor capable of securing excellent characteristics by causing magnetic flux density to be distributed uniformly within a core.

According to an aspect of the present disclosure, an inductor includes a body including a coil part therein. The coil part includes a first coil layer connected to a first via; a second coil layer connected to a second via formed in a position different from that of the first via and disposed below the first coil layer; and a via connection layer disposed between the first coil layer and the second coil layer and connected to the first and second vias.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Exemplary embodiments in the present disclosure will now be described in detail with reference to the accompanying drawings.

Hereinafter, an inductor of the present disclosure will be described with reference to the accompanying drawings, and, for the purposes of description, a structure of an inductor will be described as an example, but the inductor of the present disclosure may also be applied to various other purposes.

Figure 1:
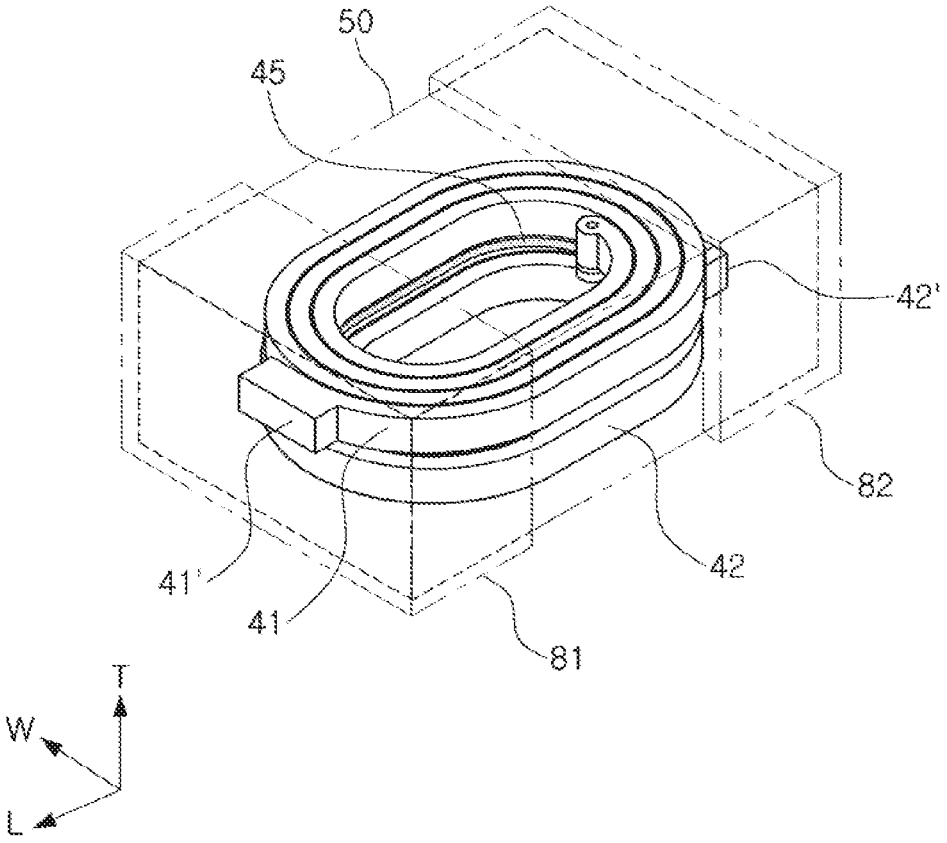
FIG. 1 is a schematic perspective view of an inductor including a coil part according to an exemplary embodiment in the present disclosure.
Figure 2:
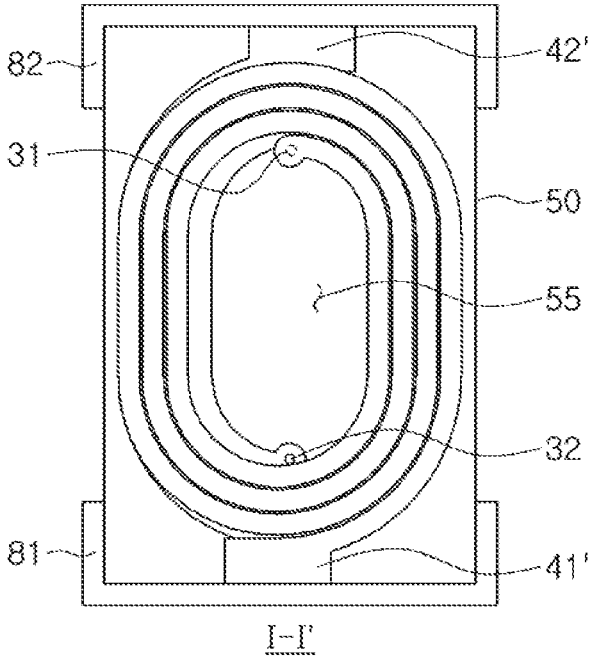
FIG. 2 is a schematic plan view of the inductor of FIG. 1.
Figure 3:
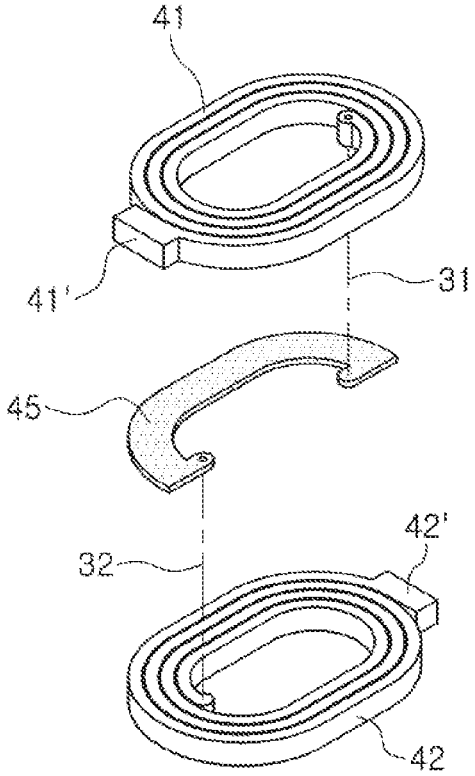
FIG. 3 is a schematic exploded view of a coil part of an inductor according to an exemplary embodiment in the present disclosure.

FIG. 1 is a schematic perspective view of an inductor including a coil part according to an exemplary embodiment in the present disclosure, FIG. 2 is a schematic plan view of the inductor of FIG. 1, and FIG. 3 is a schematic exploded view of a coil part of an inductor according to an exemplary embodiment in the present disclosure.

Referring to FIGS. 1 through 3, an inductor 100 according to an exemplary embodiment in the present disclosure includes a body 50 including a coil part therein, and the coil part includes a first coil layer 41 connected to a first via 31, a second coil layer 42 connected to a second via 32, formed in a position laterally displaced from that of the first via and disposed below the first coil layer, and a via connection layer 45, disposed between the first coil layer 41 and the second coil layer 42 and connected to the first and second vias 31 and 32.

The body 50 forms an appearance of the inductor 100. In FIG. 1, L, W, and T indicate a length direction, a width direction, and a thickness direction, respectively. The body 50 may have a hexahedral shape including a first surface and a second surface opposed in a stacking direction (the thickness direction) of the coil layers, a third surface and a fourth surface opposed in the length direction, and a fifth surface and a sixth surface opposed in the width direction, but the shape of the body 50 is not limited thereto. Corners where the first to sixth surfaces meet may be rounded through grinding, or the like.

The body 50 may include a magnetic material exhibiting magnetic properties.

The body 50 may be formed by forming a coil part, stacking sheets including a magnetic material on upper and lower surfaces of the coil part, and subsequently compressing and curing the sheets. The magnetic material may be, for example, a resin including ferrite or a magnetic metal particle.

The body 50 may be in a form in which ferrite or a magnetic metal particle is dispersed in a resin.

The ferrite may include a material such as Mn—Zn-based ferrite, Ni—Zn-based ferrite, NI-Zn—Cu-based ferrite, Mn—Mg-based ferrite, Ba-based ferrite, or Li-based ferrite, and the like.

The magnetic metal particle may include one or more selected from the group consisting of iron (Fe), silicon (Si), chromium (Cr), aluminum (Al), and nickel (Ni). For example, the magnetic metal particle may be a Fe—Si—B—Cr-based amorphous metal but not limited thereto. A diameter of the magnetic metal particle may be about 0.1 to 30 μm.

The resin may be a thermosetting resin such as an epoxy resin or a polyimide resin.

The coil part may perform various functions in an electronic device through properties manifested from a coil of the inductor 100. For example, the inductor 100 may be a power inductor, and, in this case, the coil part may serve to store electricity in the form of a magnetic field to maintain an output voltage to stabilize power.

A support member (not shown) may not be limited as to material or type, as long as it is able to support the plurality of coil layers 41 and 42. For example, the support member may be a copper clad laminate (CCL), a polypropyleneglycol (PPG) substrate, a ferrite substrate, a metal-based soft magnetic substrate, and the like. Also, the support member may be an insulating substrate formed of an insulating resin.

As the insulating resin, a thermosetting resin such as an epoxy resin, a thermoplastic resin such as polyimide, or a resin obtained by impregnating the thermosetting resin or the thermoplastic resin with a stiffener such as a glass fiber or an inorganic filler, for example, prepreg, Ajinomoto build-up film (ABF), FR-4, a bismaleimide triazine (BT) resin, a photo imageable dielectric (PID) resin, and the like, may be used. From the vantage point of maintaining rigidity, an insulating substrate including a glass fiber or an epoxy resin may be used but the invention is not limited thereto.

A hole may penetrate through a central portion of the support member, and the hole may be filled with a magnetic material such as ferrite, a magnetic metal particle, and the like, to form a core part 55. Formation of the core part 55 filled with the magnetic material may enhance inductance L.

In the related art inductor, a via pad larger than a via is applied to a coil part in a portion where the via is positioned, to connect coil layers positioned on upper and lower sides. Here, due to an area of the via pad, a core may not be uniformly filled with a magnetic material and magnetic flux density may concentrate in a region, to degrade properties of the inductor.

The inductor 100, according to the present exemplary embodiment, includes the first and second vias 31 and 32, respectively connected to the first and second coil layers 41 and 42 and formed in different positions displaced laterally from each other, and the via connection layer 45, disposed between the first and second coil layers and connected to the first and second vias 31 and 32. In order to make a magnetic flux density uniform within the core part 55, the first and second vias 31 and 32 may be formed in different positions.

With respect to the core part 55, the first via 31 may be disposed on a first side of the core part 55 and the second via 32 may be disposed on a second side of the core part 55.

That is, the first and second coil layers 41 and 42 are respectively connected to the first and second vias 31 and 32, formed in different positions, and are electrically connected through the via connection layer 45 connecting the first and second vias 31 and 32.

Coil patterns of the first and second coil layers 41 and 42 may have an oval shape or a track shape. That is, the coil patterns of the first and second coil layers may have a shape with an aspect ratio exceeding 1, that is, having a longer axis and a shorter axis.

The first and second vias 31 and 32 may be formed to be positioned on the longer axis of the coil patterns.

Table 1, below, shows a comparison of inductance, direct current resistance (Rdc) and saturation current (Isat) values between a comparative example and an inventive example in the present disclosure.

The comparative example is an inductor in which a via is formed on a shorter axis of coil patterns, and the inventive example in the present disclosure is an inductor in which the via is formed on a longer axis of the coil patterns.

TABLE 1

| Classification | Inductance (uH) | Rdc (mOhm) | Isat (A) |
|---|---|---|---|
| Comparative example | 2.0278 | 272.43 | 1.85 |
| Inventive example | 2.0226 | 246.23 | 1.9 |

Referring to Table 1, in the comparative example, since the via is positioned on the shorter axis of the coil patterns, a magnetic flux density concentrates in a shorter axis direction, in which a distance between the coil patterns is relatively short, reducing the Isat and increasing the Rdc.

In contrast, in the inventive example, since the via is positioned on the longer axis of the coil patterns, it can be seen that Rdc is reduced by 11% and Isat is increased by 3%, relative to those of the comparative example. That is, in the inventive example in the present disclosure, the Rdc and Isat properties are enhanced, to enhance performance of the inductor.

Figure 4A:
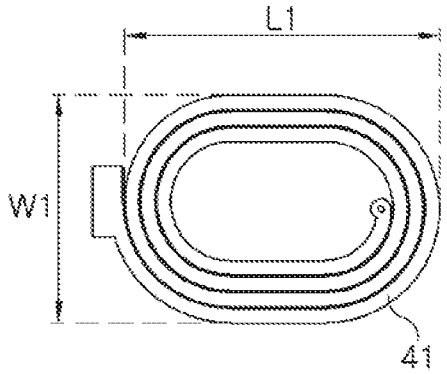
FIGS. 4A and 4B are schematic plan views of a coil layer of the coil part of FIG. 2.
Figure 4B:
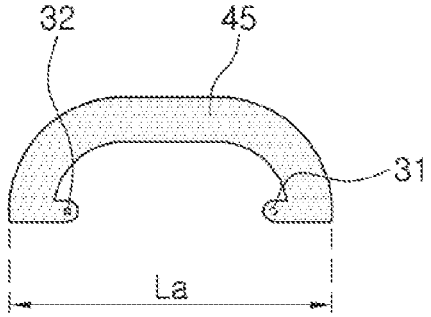

FIG. 3 is a schematic exploded view of a coil part of an inductor according to an exemplary embodiment in the present disclosure, and FIG. 4 is a schematic plan view of a coil layer of the coil part of FIG. 2.

Referring to FIGS. 3 and 4, an inductor 100 according to an exemplary embodiment in the present disclosure may have a structure including the first and second coil layers 41 and 42 and the via connection layer 45, in which a plurality of via connection layers may be three or more layers.

Since the first and second vias 31 and 32 are formed in different positions displaced laterally from each other, the via connection layer 45, connecting the vias 31 and 32, is provided.

The via connection layer 45 may have a plurality of layers, and a coil pattern of the via connection layer 45 may have ½ turn or a plurality of turns. The number of turns of the coil pattern may be adjusted according to the aspect ratio, and although a cross-section of the coil pattern is reduced, the number of turns may be increased, allowing high inductance of the inductor 100 to be advantageously realized. For example, in a case in which the coil pattern of the via connection layer 45 has ½ turn, the coil pattern may have a shape in which a width thereof is greater than a thickness thereof, that is, an aspect ratio is less than 1.

The coil pattern of the via connection layer 45 may be smaller than or equal to an area of the coil patterns of the first and second coil layers 31 and 32, and may overlap the coil patterns of the first and second coil layers 31 and 32.

In a case in which the via connection layer 45 includes an odd number of layers, the via connection pattern of the via connection layer 45 may include a layer having a ½ turn.

An overall length La of the via connection pattern having a ½ turn may be smaller than or equal to an overall length L1 of the coil patterns of the first and second coil layers 31 and 32.

In a case in which the via connection layer 45 includes an even number of layers, the via connection layer 45 may include first and second via connection patterns, and the first and second via connection patterns may have a plurality of turns.

The first and second coil layers 41 and 42, stacked on each of both surfaces of the support member, are electrically connected through a via (not shown) or a via connection layer penetrating through the support member. In a case in which the via connection layer is formed to include an odd number of layers, one via connection pattern may be formed to penetrate through the support member.

The via penetrating through the support member may be formed by forming a through hole using mechanical drilling, laser drilling, and the like, and subsequently filling the inside of the through hole with a conductive material through plating.

The via may not be limited in shape or material as long as it is able to electrically connect the first coil layer 41 and the second coil layer 42, respectively disposed on opposing surfaces of the support member. Here, the upper side and the lower side are determined with respect to a stacking direction of the coil layers in the drawing.

The via may have any shape known in the art, such as a tapered shape, in which a diameter is decreased or increased downwardly, a cylindrical shape, in which a diameter is substantially uniform downwardly, a hourglass shape, and the like.

The first and second coil layers 41 and 42 and the via connection layer 45 are electrically connected through the via (not shown) penetrating through an insulating layer (not shown) disposed therebetween. As a result, the first and second coil layers and the via connection layer are electrically connected to form a single coil.

The coil part includes the first and second coil layers, formed on opposing surfaces of the support member, and includes the via connection layer, formed to penetrate through the first and second coil layers disposed on the support member or formed between the support member and the first and second coil layers. An insulating layer is disposed between the first and second coil layers and the via connection layer.

The first and second coil layers and the via connection layers may be formed through a photolithography method or a plating method.

The insulating layer (not shown) serves to insulate the coil patterns of the first and second coil layers 41 and 42 and the coil pattern of the via connection layer 45.

The insulating layer may be formed by laminating a precursor film including an insulating material on the support member with the via connection layer formed thereon, and subsequently curing the precursor film. Thereafter, the first coil layer 41 or the second coil layer 42 may be formed on the insulating layer.

The insulating layer may be a built-up film including an insulating material, and, for example, a thermosetting resin such as an epoxy resin, a thermoplastic resin such as polyimide, a resin obtained by impregnating the thermosetting resin or the thermoplastic resin with a reinforcement agent such as an inorganic filler, for example, an Ajinomoto build-up film (ABF), or the like, may be used. Alternatively, the insulating layer may be an insulating film including a known photo imageable dielectric (PID) resin.

A thickness of the insulating layer may be greater than that of the via connection layer 45. That is, the insulating layer may have a thickness sufficiently insulating the via connection layer 45 from the first and second coil layers, while covering the via connection layer 45.

The via penetrating through the insulating layer may not be particularly limited in shape or material as long as it can electrically connect the first and second coil layers 41 and 42 and the via connection layer 45.

The via penetrating through the insulating layer may be formed in a manner of filling a through hole formed using at least one of a photography method, mechanical drilling, and laser drilling, with a conductive material through plating.

The via may have any shape known in the art, such as a tapered shape, a cylindrical shape, and the like, as mentioned above.

As a material of the via, a conductive material such as copper (Cu), aluminum (Al), silver (Ag), tin (Sn), gold (Au), nickel (Ni), lead (Pb), or an alloy thereof may be used. A thickness of the insulating layers may be smaller than a thickness of the support member.

The first and second coil layers 41 and 42 may be coated with an insulating film (not shown).

The insulating film serves to protect the coil patterns of the first and second coil layers 41 and 42.

The insulating film may be formed of any material as long as the material includes an insulating material including, for example, an insulating material used for general insulating coating, for example, an epoxy resin, a polyimide resin, a liquid crystal polymer resin, and the like. In addition, a known photo imageable dielectric (PID) resin, or the like, may also be used, but the material is not limited thereto.

The insulating film may be integrated with the insulating layer according to a manufacturing method, but is not limited thereto.

The coil patterns of the first and second coil layers 41 and 42 may have a shape having a predetermined width from an upper surface to a lower surface.

In the first and second coil layers 41 and 42, in order to secure properties of the inductor while increasing a thickness of the coil patterns, isotropic plating and anisotropic plating may be performed to increase a coil thickness, after plating of the coil patterns. Accordingly, a thickness of final coil patterns of the first and second coil layers 41 and 42 may be greater than a width thereof.

Thus, when an aspect ratio of the coil patterns exceeds 1, the coil patterns of the first and second coil layers 41 and 42 may have a larger number of turns on the same plane. That is, even though a cross-sectional area of the coil part is reduced, since the number of turns is increased, high inductance may be advantageously realized.

In order to have a sufficient number of turns, the first and second coil layers and the via connection layer may be formed to maximize utilization of a space thereof in a horizontal direction, i.e., in the length direction or the width direction.

The first and second coil layers 41 and 42 and the via connection layer 45 may be stacked vertically and may have overlapping areas. Thus, the inductor of the present disclosure may realize sufficient coil properties, in spite of being thin.

When the number of turns of the coil pattern of the via connection layer is x and the number of turns of the coil patterns of the first and second coil layers is y, $x \leq y$ may be satisfied. Here, shortcomings due to isotropic plating and anisotropic plating may be reduced, and since a larger number of turns is realized, higher inductance may be realized.

Figure 5:
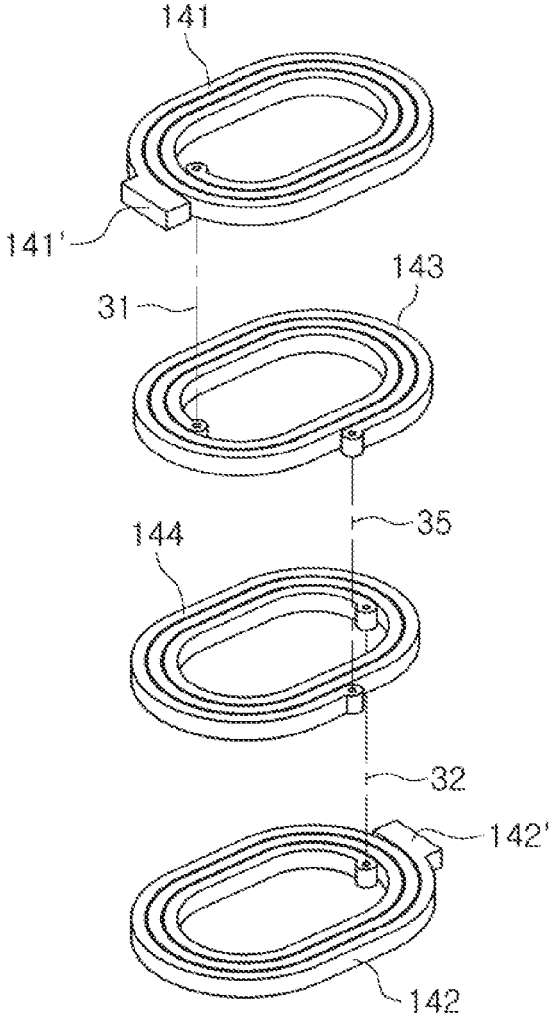
FIG. 5 is a schematic exploded view of a coil part of an inductor according to another exemplary embodiment in the present disclosure.
Figure 6A:
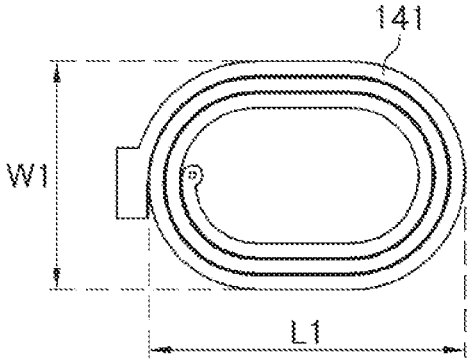
FIGS. 6A and 6B are schematic plan views of a coil layer of the coil part of FIG. 5.
Figure 6B:
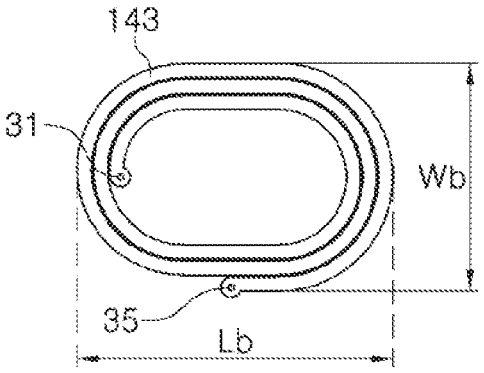
Figure 7:
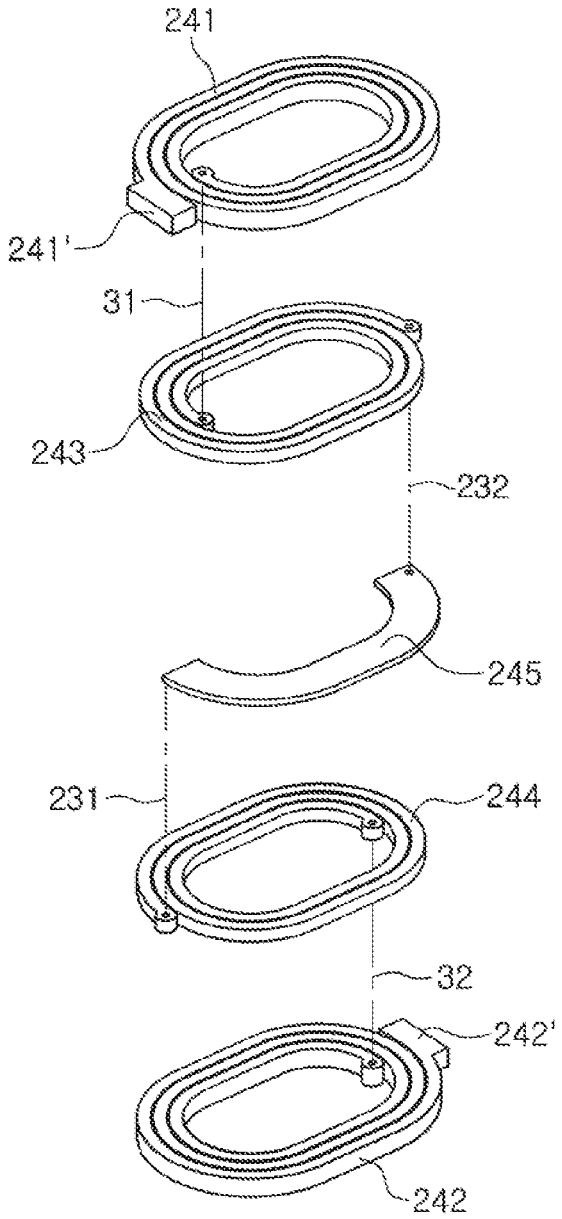
FIG. 7 is a schematic exploded view of a coil part of an inductor according to another exemplary embodiment in the present disclosure.

FIG. 5 is a schematic exploded view of a coil part of an inductor according to another exemplary embodiment in the present disclosure; FIGS. 6A and 6B are schematic plan views of coil layers of the coil part of FIG. 5; and FIG. 7 is a schematic exploded view of a coil part of an inductor according to another exemplary embodiment in the present disclosure.

Descriptions of the same components as those illustrated in FIGS. 1 to 4 will be omitted.

Referring to FIGS. 5, 6A and 6B, the via connection layer may include two layers (an even number of layers) and may include first and second via connection patterns 143 and 144.

The first and second via connection patterns 143 and 144 may have a plurality of turns.

A length Lb and a width Wb of the first and second via connection patterns 143 and 144 may be smaller than or equal to a length L1 and a width W1 of the coil patterns of the first and second coil layers 141 and 142.

The first and second via connection patterns 143 and 144 may include vias 31 and 32 for connecting the first and second coil layers 141 and 142, and a via 35 for connecting the first and second via connection patterns 143 and 144.

The vias 31 and 32, for connecting the first and second coil layers 141 and 142, may be formed on a longer axis line of the first and second via connection patterns 143 and 144, and the via 35, for connecting the first and second via connection layers, maybe formed on an outer surface of the coil patterns of the first and second via connection layers.

Referring to FIG. 7, the via connection layer may include three layers (an odd number of layers) and may include a coil pattern 245 having ½ of a turn and coil patterns 243 and 244 having a plurality of turns. Here, the vias 31 and 32 connecting the first and second coil layers 141 and 142 and the vias 231 and 232 connecting a plurality of coil patterns within the via connection layer may be formed on a longer axis line of the coil pattern, and the vias 231 and 232 for connecting the coil pattern of the plurality of via connection layers may be formed on an outer surface of the coil pattern of the via connection layer having the plurality of turns.

All the coil patterns of the first and second coil layers may have a plurality of turns. Here, the first and second coil layers 241 and 242 mostly have coil patterns having a thin line width, thus basically having a large number of turns in the length direction and in the width direction.

The first and second coil layers 41 and 42 and the via connection layer 45 may have the same rotational direction and be electrically connected through the first and second vias 31 and 32 formed in different positions, having an effect of increasing the number of turns of the coil, even in a stacking direction of the coil layer. The first and second coil layers 41 and 42 and the via connection layer 45 may have the number of turns greater or fewer than that illustrated in the drawings, and such a modification may be obvious to the person skilled in the art.

In the drawing, it is illustrated that the via connection layer has one to three layers, but more coil layers may also be formed, and an insulating layer with a via may be disposed therebetween to electrically connect them. In this case, the contents of the via connection layer may be applied to the additional coil layer. Also, a coil layer maybe further formed between the first and second coil layers, and an insulating layer with a via may be disposed therebetween to electrically connect them. In this case, also, the contents of the first and second coil layers may be applied to the additional coil layer.

External electrodes 81 and 82 are electrically connected to lead-out terminals 41' and 42' of the first and second coil layers 41 and 42 exposed to both end surfaces of the body 50, respectively.

When the inductor 100 is mounted in an electronic device, the external electrodes 81 and 82 serve to electrically connect the coil part of the inductor 100 to the electronic device.

The external electrodes 81 and 82 may be formed of conductive paste including a conductive metal, and the conductive metal may be at least one of copper (Cu), nickel (Ni), tin (Sn), and silver (Ag), or an alloy thereof.

The external electrodes 81 and 82 may include a plating layer formed on the paste layer.

The plating layer may include one or more selected from the group consisting of nickel (Ni), copper (Cu), and tin (Sn), and, for example, a nickel layer and a tin layer may be sequentially formed therein.

As set forth above, according to an exemplary embodiment in the present disclosure, excellent properties of the inductor may be secured by causing a magnetic flux density to be uniformly distributed within the core.

While exemplary embodiments have been shown and described above, it will be apparent to those skilled in the art that modifications and variations could be made without departing from the scope of the present invention as defined by the appended claims.

What is claimed is:

1. An inductor comprising:

a body including a coil part therein, wherein the coil part includes:

a first coil layer electrically connected to a first via;

a second coil layer disposed below the first coil layer and electrically connected to a second via laterally displaced from the first via; and a via connection layer disposed between the first coil layer and the second coil layer and electrically connected to the first and second vias, wherein each of the first and second coil layers has a spiral shape including a plurality of turns, wherein a collective line width of the via connection layer is wider than a line width of each turn of at least one of the first or second coil layer, and wherein the via connection layer includes a first coil pattern having a ½ turn.

2. The inductor of claim 1, wherein the coil part further includes a core part at the center thereof, the first via is disposed on a first side of the core part, and the second via is disposed on a second side of the core part.

3. The inductor of claim 1, wherein coil patterns of the first and second coil layers have an oval or track shape having a longer axis and a shorter axis when viewed from above, and the first and second vias are positioned on the longer axis.

4. The inductor of claim 1, wherein the via connection layer includes a plurality of coil patterns.

5. The inductor of claim 4, wherein the plurality of coil patterns includes a second coil pattern having a plurality of turns.

6. The inductor of claim 4, wherein the plurality of coil patterns includes the first coil pattern.

7. The inductor of claim 6, wherein the plurality of coil patterns further includes a plurality of second coil patterns having a plurality of turns, and the first coil pattern is disposed between two of the plurality of the second coil patterns.

8. The inductor of claim 7, wherein the number of plurality of the second coil patterns is even, and the first coil pattern is disposed between a half of the plurality of the second coil patterns and the other half of the plurality of the second coil patterns.

9. The inductor of claim 1, wherein the via connection layer includes a coil pattern having an area smaller than or equal to that of coil patterns of the first and second coil layers.

10. An inductor comprising:

a body including a coil part therein, wherein the coil part includes a via connection layer disposed between first and second coil layers, the first and second coil layers are electrically connected to vias, the vias being displaced laterally from each other, and the via connection layer is electrically connected to the first and second coil layers through the vias, wherein each of the first and second coil layers has a spiral shape including a plurality of turns, wherein a collective line width of the via connection layer is wider than a line width of each turn of at least one of the first or second coil layer, and wherein the via connection layer includes a first coil pattern having a ½ turn.

11. The inductor of claim 10, wherein the coil part further includes a core part at the center thereof, and the vias are disposed on first and second sides of the core part.

12. The inductor of claim 10, wherein coil patterns of the first and second coil layers have an oval or track shape having a longer axis and a shorter axis when viewed from above, and the vias are positioned on the longer axis.

13. The inductor of claim 10, wherein the via connection layer includes a plurality of coil patterns.

14. The inductor of claim 13, wherein the plurality of coil patterns includes a second coil pattern having a plurality of turns.

15. The inductor of claim 13, wherein the plurality of coil patterns includes the first coil pattern.

16. The inductor of claim 15, wherein the plurality of coil patterns further includes a plurality of second coil patterns having a plurality of turns, and the first coil pattern is disposed between two of the plurality of the second coil patterns.

17. The inductor of claim 16, wherein the number of plurality of the second coil patterns is even, and the first coil pattern is disposed between a half of the plurality of the second coil patterns and the other half of the plurality of the second coil patterns.

18. The inductor of claim 10, wherein the via connection layer includes a coil pattern having an area smaller than or equal to that of coil patterns of the first and second coil layers.

* * * * *